United States Patent [19]

Parker

[11] Patent Number: 4,782,540

[45] Date of Patent: Nov. 8, 1988

[54] SLEEPER SOFA MATTRESS

[76] Inventor: Robert K. Parker, No. 6 Northridge Cir., Johnson City, Tenn. 37601

[21] Appl. No.: 161,359

[22] Filed: Feb. 22, 1988

Related U.S. Application Data

[63] Continuation of Ser. No. 917,728, Oct. 10, 1986, abandoned.

[51] Int. Cl.[4] ..... A47C 27/00

[52] U.S. Cl. ..... 5/249; 5/465; 5/471

[58] Field of Search ..... 5/13, 37 R, 47, 249, 5/250, 465, 471, 475, 478

[56] References Cited

U.S. PATENT DOCUMENTS

| | | | |
|---|---|---|---|
| 2,168,037 | 8/1939 | Marsack | 5/474 |
| 2,335,036 | 11/1943 | Young | 5/47 |
| 2,865,030 | 12/1958 | Carrick | 5/37 R |
| 3,110,043 | 11/1963 | Tyhanic | 5/248 |
| 3,249,952 | 5/1966 | Janapol | 5/465 |
| 3,354,477 | 11/1967 | Bartz | 5/465 |
| 3,906,557 | 9/1975 | Barabas | 5/13 |

*Primary Examiner*—Michael F. Trettel
*Attorney, Agent, or Firm*—Kinzer, Plyer, Dorn, McEachran & Jambor

[57] ABSTRACT

A sofa bed mattress is disclosed. The mattress may be extended to provide a sleeping surface, and may be folded about transverse flexure lines for storage within a sofa or other configuration. The sofa bed mattress includes an inner spring unit and an overlying top cushion. The top cushion is secured to the inner spring unit substantially along the transverse flexure lines so that the position of the top cushion relative to the inner spring unit is substantially maintained when the mattress is folded.

16 Claims, 1 Drawing Sheet

SLEEPER SOFA MATTRESS

This is a continuation of co-pending application Ser. No. 917,728 filed on Oct. 10, 1986, now abandoned.

BACKGROUND OF THE INVENTION

This invention relates to mattresses, and more particularly to sleeper sofa mattresses of the type having an inner spring unit and an overlying top cushion. In conventional mattresses having inner spring units and top cushions, it has been known to secure the top cushion to the underlying inner spring through lines of transverse stitching. Such constructions are illustrated in U.S. Pat. Nos. 3,110,043 and 2,168,037. As illustrated in these patents, a narrow strip or flange may be secured to the inner face of the top cushion at the lines of transverse stitching and secured to the spring construction by suitable means, such as hog rings. As illustrated in these patents, two lines of transverse stitching typically divide the mattress into three sections providing extra support in the center one-third of the mattress where body weight is concentrated.

In contrast to conventional mattresses, sleeper sofa mattresses are designed to be foldable and extendable. Such mattresses may be extended to provide a flat sleeping surface and may be folded along transverse flexures for storage within the sofa. When folded, a part of the mattress may be doubled over, providing a flat surface for the placement of sofa seat cushions, and part of the mattress may be angled upwardly to fit within the back of the sofa. In many sleeper sofas, the head of the mattress and support frame are designed to be angled upwardly to provide a raised headrest for reading or television viewing. However, when the sleeper sofa mattress is of the type having an inner spring unit and an overlying top cushion, folding the mattress and raising the headrest may cause the top cushion to bunch and shift position. This bunching and shifting may make it more difficult to fold the mattress When the mattress is folded with the sofa, the bunching and shifting may reduce the sofa's seating comfort. And, over time, the bunching and shifting may shorten the useful life of the mattress.

SUMMARY OF THE INVENTION

The device of the present invention provides a sleeper sofa mattress that can be easily folded for storage without bunching or shifting of the top cushion. Bunching and shifting are also eliminated when the mattress's head rest is raised To eliminate bunching and shifting, the mattresses top cushion is secured to the underlying inner spring unit along a plurality of transverse lines, spaced at predetermined intervals. This construction allows only limited movement of the top cushion with respect to the inner spring unit. This construction provides increased support at the mattress's center section for sleeping comfort, and also enhances seating comfort when the mattress is folded into the sofa. Thus, the present invention provides a sleeper sofa mattress that is comfortable, durable, and easily folded.

Accordingly, the present invention provides a sleeper sofa mattress that is adapted to be extended flat to provide a sleeping surface, and to be folded about transverse flexure lines for storage within a sofa configuration. The sleeper sofa mattress includes an inner spring unit and an overlying top cushion. The mattress also includes means for securing the top cushion to the inner spring unit so that the position of the cushion relative to the inner spring unit is substantially maintained when the mattress is folded. The securing means are disposed substantially along the transverse flexure lines so as to provide positive folding of the top cushion along with the spring at the appropriate location.

BRIEF DESCRIPTION OF THE DRAWINGS

FIG. 4 is a side view of the mattress of FIG. 1, folded for storage within a sofa.

DETAILED DESCRIPTION OF THE ILLUSTRATED EMBODIMENT

Figures 1, 2, 3, 4, 5:
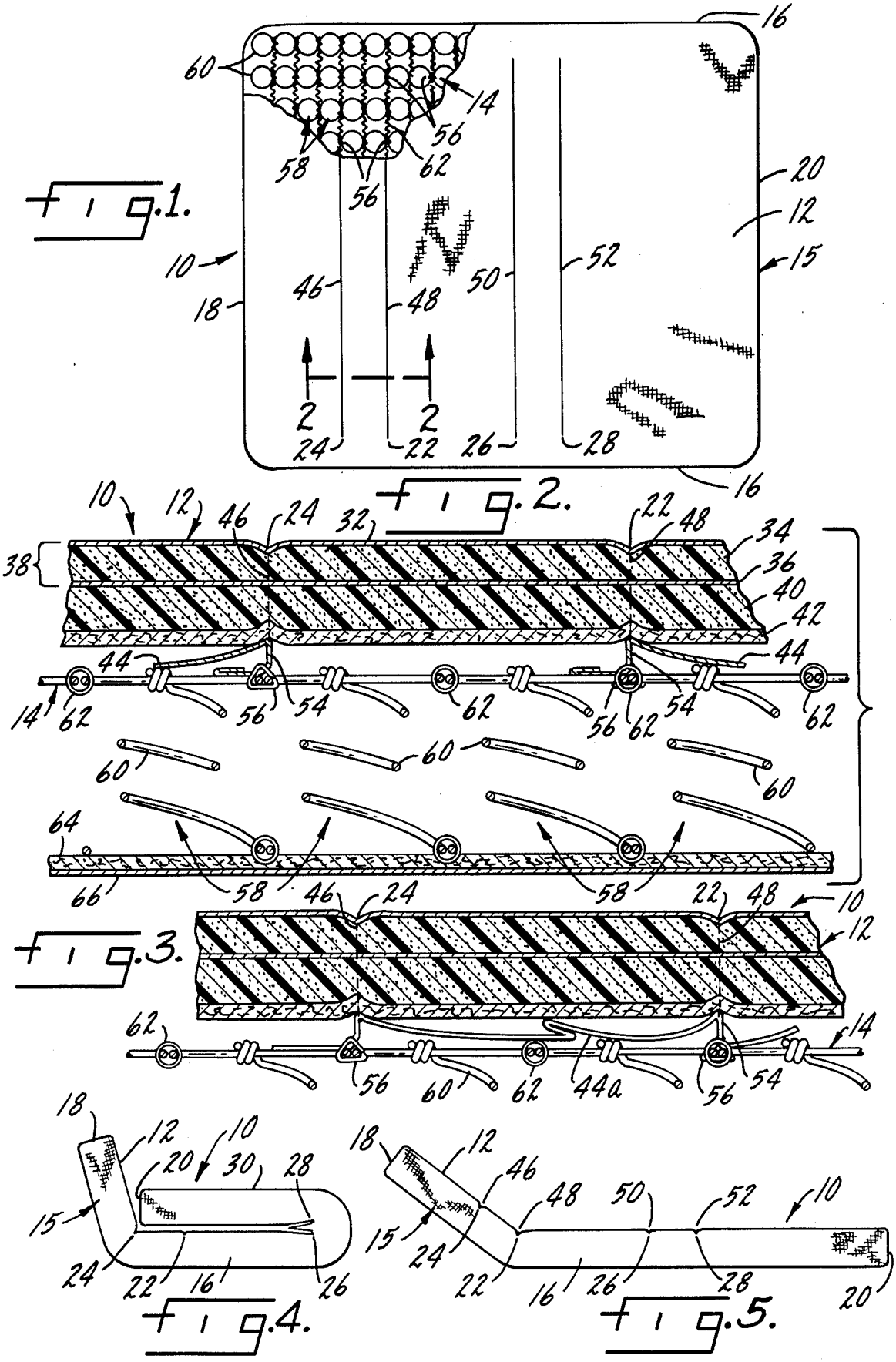
FIG. 1 is a top view of a sleeper sofa mattress embodying the principles of the present invention, with a portion of the top cushion removed.
FIG. 2 is an enlarged cross-section of the mattress, taken along line 2—2 of FIG. 1.
FIG. 4 is an enlarged partial cross-section of another embodiment of the mattress.
FIG. 5 is a side view of the mattress of FIG. 1, extended for use and with its head rest raised.

In the accompanying drawings, there is illustrated a sleeper sofa mattress embodying the principles of the present invention. The illustrated sleeper sofa mattress is designed to be extended to provide a sleeping surface, and to be folded about transverse flexure lines or positions for storage within a sofa configuration. When extended, the mattress also provides a headrest which may be raised for comfort in reading or television viewing. When folded within the sofa, a part of the mattress angles upwardly into the back of the sofa, and the remainder of the mattress is doubled over, to provide a surface for the placement of the sofa seat cushions. In both folding the mattress and in raising the headrest, the mattress's top cushion is arranged so that it will not bunch or shift position because the top cushion is secured to the underlying inner spring unit along the lines of fold. This construction facilitates folding the mattress, enhances the sofa's seating comfort because of the absence of bunched cushion material underlying the seat cushion, and enhances the mattress's support of the sleeper's lumbar region.

Referring to FIG. 1, the illustrated sleeper sofa mattress, generally designated 10, is shown fully extended. The mattress 10 has a top cushion 12 overlying an inner spring unit 14. The top cushion is a part of the overall cover 15 in which the spring is encased. The inner spring unit 14 extends between the mattress's longitudinal sides 16 and its head 18 and foot 20 ends.

To provide a head rest for reading or television viewing, the head end 18 of the mattress 10 may be raised to provide a headrest, as shown in FIG. 5. Typically, the mattress 10 would be supported on a foldable frame (not shown) which can be locked into the head rest position shown. Suitable support frames and sofa constructions are known in the art and may be used with the mattress of the present invention. To raise the mattress's headrest, the head end 18 of the illustrated mattress must be angled upwardly about a transverse head rest flexure line 22.

To fold the mattress 10 for storage within the sofa, the illustrated mattress must be folded about a plurality of transverse storage flexure lines 24, 26, 28, as shown in FIG. 4. As shown, the foot end 20 of the mattress is doubled over the center of the mattress about two flexure lines 26, 28 with the foot end overlying flexure line 22. The head end 18 of the mattress is angled upwardly about flexure line 24. When the mattress is folded as shown in FIG. 4, the upwardly-angled head end 18 fits within the back of the sofa, and the sofa seat cushions are set upon the flat underside 30 of the foot end 20 of the mattress.

To prevent bunching or shifting of the top cushion 12 of the mattress 10 when the mattress is folded, as shown in FIG. 4, or when the head rest is raised, as shown in FIG. 5, the present invention provides means for securing the top cushion to the inner spring unit. The securing means are disposed substantially along the transverse flexures 22, 24, 26, 28. The securing means provide positive fold hinges for folding and angling the mattress, and serve to substantially maintain the position of the top cushion 12 relative to the inner spring unit 14.

Suitable securing means for the top cushion 12 are illustrated in FIG. 2. In the illustrated embodiment, the top cushion is layered. It has a top layer of ticking 32 overlying a layer of polyurethane foam 34, which overlies a quilt backing layer 36; these top three layers are quilted together, as indicated at 38. Under these top three layers 32, 34, 36, the top cushion 12 has another layer of polyurethane foam 40 and a polyester fiber pad 42. To secure the layered top cushion 12 to the inner spring unit 14, transverse flanges 44 are secured to the top cushion 12 substantially at each flexure line 22, 24, 26, 28.

In the illustrated embodiment, each flange 44 comprises an elongated narrow sheet of material, such as cloth, or non-woven flexible material secured to the top cushion 12 by transverse lines of stitching 46, 48, 50, 52 which extend through all of the layers of the top cushion 12, as shown in FIG. 2. As shown in FIG. 1, each transverse line of stitching 46, 48, 50, 52 and each attached flange 44, extends substantially between the longitudinal sides 16 of the mattress 10, along the mattress's flexures 22, 24, 26, 28.

As shown in FIG. 2, each flange 44 has a downwardly-extending portion 54, through which each flange is secured to the underlying inner spring unit 14. As shown in FIG. 2, the downwardly-extending portion 54 of each flange 44 is secured to the inner spring unit 14 by a plurality of clips 56, or hog rings. In the illustrated embodiment, the downwardly-extending portion 54 of each flange 44 is doubled over during manufacture, so that the flange is pierced twice by each hog ring 56. As shown, the connections between the hog rings 56 and the flanges 44 may be spaced below the stitching of the flange to the top cushion, to allow limited movement of the top cushion with respect to the inner spring unit.

As shown in FIG. 2, each hog ring 56 is also secured to the inner spring unit 14. In the illustrated embodiment, the inner spring unit 14 comprises a plurality of transverse adjacent rows 58 of spaced individual springs 60. Each individual spring 60 is helical, and has an hourglass shape. The springs 60 in each row 58, and adjacent rows of springs are connected by transversely-extending helical wires 62. The inner spring unit 14 overlies a polyester fiber pad 64 and a bottom layer of ticking 66 which are part of the cover 15. Since the mattress must fold, the spring unit does not include a peripheral stiffener rod as would be found in a conventional non-folding mattress.

As shown in FIG. 2, each hog ring 56 secures the flange 44 to two springs 60 on adjacent rows 58 of springs by encircling the tops of the two springs. As shown in FIG. 1, the hog rings 56 are disposed at intervals across the mattress; in the illustrated embodiment, the hog rings are connected to alternate springs in each row. Each transverse line of stitching 46, 48, 50, 52 overlies the junction of two adjacent rows 58 of springs, along the mattress's flexure lines or positions. Thus, the top cushion 12 is secured to the inner spring unit 14 along the lines about which the mattress folds or angles. In effect, this construction provides positive hinges about which the mattress may fold or bend, without bunching or shifting of the top cushion, enhancing the seating comfort of the sofa as well as the appearance and durability of the mattress. This construction also enhances the mattress's support of the sleeper, providing firmer support for the sleeper's lumbar region, where body weight is concentrated.

The positions of the securing means in the present invention depend upon mattress thickness and the folding mechanism geometry. In the illustrated embodiment, with the folding and head rest positions shown in FIGS. 4 and 5, the mattress is about 5¼ inches thick, 5½ inches wide, and 71 inches long. The distance from the head end 18 of the mattress to the first line of stitching 46 at storage line 24 is about 13½ inches; from the first line 46 to the second line of stitching 48 at the head rest flexure line 22 is about 6¼ inches; from the second line 48 to the third line of stitching 50 at storage flexure line 26 is about 17½ inches; and from the third line 50 to the fourth line of stitching 52 at storage flexure line 28, about 6¼ inches. The illustrated inner spring unit 14 has 23 rows of springs, each row having 13 springs, each spring having a 3 inch diameter. The juncture of the fourth and fifth rows of springs, from the head end, underlies the first line of stitching 46; the juncture of the sixth and seventh rows of springs underlies the second line of stitching 48; the juncture of the eleventh and twelfth rows of springs underlies the third line of stitching 50; and the juncture of the thirteenth and fourteenth rows of springs underlies the fourth line of stitching 52. Each line of stitching 46, 48, 50, 52 corresponds to a transverse flexure lines 22, 24, 26, 28 of the mattress, such that the top cushion 12 is secured to the inner spring unit 14 along transverse lines at the mattress's flexures. The top cushion 10 is secured to the spring 12 by the hog rings 56 in portions 54 of flanges 44. The transverse flexure lines and hence the stitch lines 46, 48, 50, 52 are located at predetermined positions where the mattress is to fold for either raised head rest or storage positioning. The connection of the top cushion to the mattress at these positions necessarily requires the top cushion to fold at the juncture where the spring folds and provides positive folding of the top cushion.

In making the illustrated mattress 10, the top three layers 32, 34, 36 may be quilted together using a multi-needle quilt machine. The flanges 44 may be secured to the top cushion 12 by stitching the top cushion and the flanges together with the panel quilt machine. The top cushion 12, with the attached flanges 44, and the hog rings 56 successively attached to the springs 60 and the flanges 44. The remaining steps of manufacture may be accomplished by processes known in the art.

As an alternative to using one flange 44 at every flexure 22, 24, 26, 28 of the mattress, two wider flanges **44*a* may be used, as shown in FIG. 3. As illustrated, one wide flange 44*a* may be secured to the top cushion with two lines of stitching 46, 48, corresponding to two flexures 22, 24. The flange 44*a* has two downwardly-extending portions 54**, which may be secured to the inner spring unit as described above.

Although the invention has been described with respect to the illustrated embodiments it should be understood that the invention is not limited to those embodiments. Additional modifications and/or additions may be included by those skilled in the art without departing from the scope of the invention as defined by the claims.

I claim:

1. A sofa bed mattress adapted to be extended flat to provide a sleeping surface and to be folded about transverse flexure lines for storage within a sofa, the sofa bed mattress comprising:

a foldable inner spring unit including a plurality of uniformly-spaced rows of coil springs extending transversely across said mattress with adjacent rows of springs being connected by transversely-extending wires such that the flexure lines may be defined between any two rows of springs;

a cover encasing the spring unit and including a continuous top cushion overlying the inner spring unit to provide a sleeping surface;

each of said inner spring and said top cushion being of substantially uniform thickness;

means for securing the top cushion to the inner spring unit along at least one line extending transversely of said mattress such that the position of the top cushion relative to the inner spring unit is substantially maintained when the mattress is folded, said connection of said top cushion to said inner spring unit overlying the junction of two adjacent rows of springs to define one of said transverse flexure lines.

2. A sofa bed mattress as claimed in claim 1 wherein the extended sofa bed mattress is adapted to provide a head rest by angling a portion of the mattress upwardly about a transverse head rest flexure line, the sofa bed mattress further comprising means for securing the top cushion to the inner spring unit so that the position of the top cushion relative to the inner spring unit is substantially maintained when the head rest portion of the mattress is angled upwardly, said securing means being disposed substantially along the transverse head rest flexure line.

3. A sofa bed mattress a claimed in claim 1 wherein each securing means comprises:

an elongated flange under the top cushion;

a transverse line of stitching extending through the top cushion and the flange to secure the flange to the top cushion while leaving a portion of the flange extending downwardly; an a plurality of clips securing the downwardly-extending portion of the flange to the inner spring unit.

4. A sofa bed mattress as claimed in claim 3 wherein the top cushion is secured to the inner spring unit along at least three spaced transverse flexure lines disposed substantially along the mattress, said flexure lines disposed so that the mattress can be folded for storage within a sofa configuration.

5. A sofa bed mattress as claimed in claim 3 wherein each flange and each transverse line of stitching extends substantially across the width of the mattress, and wherein the clips are disposed at intervals substantially across the width of the mattress.

6. A sofa bed mattress as claimed in wherein the securing means comprises:

an elongated flange disposed under the top cushion and associated with two transverse flexure lines; a pair of transverse lines of stitching extending through the top cushion and through the flange to secure the flange to the top cushion, at each line of stitching while leaving a portion of the flange extending downwardly at each line of stitching, the pair of transverse lines of stitching being disposed substantially along the two associated flexure lines; and a plurality of clips securing the downwardly extending portions of the flange to the inner spring unit.

7. A sofa bed mattress as claimed in claim 6 wherein the top cushion is secured to the inner spring unit along four spaced lines through two flanges, the four spaced lines being disposed substantially along the flexure lines of the mattress, one of the flexure lines being a head rest flexure line so that a portion of the mattress can be angled upwardly about the head rest flexure to provide a head rest when the mattress is extended; the remaining flexure lines being storage flexure lines for folding the mattress into a sofa configuration.

8. A sofa bed mattress having a head end and being foldable for storage within a sofa, the sofa bed mattress comprising:

a foldable inner spring unit including a plurality of uniformly-spaced rows of coil springs extending transversely across said mattress with adjacent rows of springs being connected by transversely-extending wires such that flexure lines may be defined between any two rows of springs;

a cover including a top cushion overlying the inner spring unit;

elongated flanges disposed transversely to the top cushion and secured to the top cushion at transverse lines of stitching, each line of stitching extending through the top cushion, said flanges having downwardly-extending portions; and a plurality of clips securing the downwardly-extending portions of the flanges to the inner spring unit along transverse lines so that the position of the top cushion relative to the inner spring unit is substantially maintained when the mattress is folded, the connection of said downwardly-extending portions of the flanges to said inner spring unit overlying the junction of two adjacent rows of springs to define a transverse flexure line.

9. A sofa bed mattress as claimed in claim 8 having three transverse lines of stitching, and a downward portion of a flange extending from each such line, each such flange being secured to said spring along a line transverse of the mattress to provide a transverse fold line to allow said spring and said top cushion to fold therealong upon folding said mattress to said storage configuration.

10. A sofa bed mattress as claimed in claim 9 having four transverse lines of stitching and a downward portion of a flange extending therefrom each said flange having secured to said spring along a line transverse of the mattress to provide a transverse fold line allow said spring and said top cushion to fold therealong when said mattress is urged to fold along one of said transverse lines.

11. A sofa bed mattress as claimed in claim 1 wherein said inner spring unit includes a plurality of rows of coil springs extending transversely across said mattress, said mattress including two transverse flexure lines spaced apart a distance equal to at least two adjacent transverse rows of coil springs providing a positive hinge about which a portion of said mattress may be folded upon the remainder thereof.

12. A sofa bed mattress as claimed in claim 11 wherein said transverse flexure lines forming said hinge are spaced apart a distance equal to two adjacent transverse rows of said coil springs.

13. A sofa bed as claimed in claim 11 wherein said transverse flexure lines are positioned between adjacent rows of said coil springs.

14. A sofa bed mattress as claimed in claim 12 wherein said transverse flexure lines are positioned between adjacent rows of said coil springs.

15. A sofa bed mattress as claimed in claim 11 wherein said mattress includes two additional transverse flexure lines spaced apart a distance equal to at least two adjacent rows of said coil springs, said additional transverse flexure lines being spaced from said other transverse flexure lines a distance greater than two adjacent rows of said coil springs.

16. A sofa bed mattress as claimed in claim 15 wherein all said transverse flexure lines are positioned between adjacent rows of said coil springs.

* * * * *

UNITED STATES PATENT AND TRADEMARK OFFICE

CERTIFICATE OF CORRECTION

PATENT NO. : 4,782,540

DATED : November 8, 1988

INVENTOR(S) : Robert K. Parker

It is certified that error appears in the above—identified patent and that said Letters Patent is hereby corrected as shown below:

Column 5, claim 3, line 43, delete "a" (second occurrence) and insert --as--;

Column 5, claim 3, line 49, delete "an" and insert --and--;

Column 5, claim 6, line 63, after "in" insert --claim 1--;

Column 6, claim 10, line 57, after "line" insert --to--.

Signed and Sealed this

Twenty-first Day of May, 1991

*Attest:*

HARRY F. MANBECK, JR.

*Attesting Officer*

*Commissioner of Patents and Trademarks*